United States Patent [19]

Arii et al.

[11] Patent Number: 4,631,509

[45] Date of Patent: Dec. 23, 1986

[54] ELECTRICAL INDUCTION APPARATUS WITH SUPPORT INSIDE CASING

[75] Inventors: Kazuhiro Arii, Kobe; Yasuo Yamamoto, Settsu; Nobuyuki Sumida, Sakai; Katsumi Hanaoka, Kawanishi; Kazuhiro Tanaka, Suita, all of Japan

[73] Assignee: Allied Corporation, New York, N.Y.

[21] Appl. No.: 726,450

[22] Filed: Apr. 24, 1985

[30] Foreign Application Priority Data

Apr. 25, 1984 [JP] Japan ..... 59-61100[U]

[51] Int. Cl.[4] ..... H01F 27/06

[52] U.S. Cl. ..... 336/92; 336/197; 336/198; 336/210

[58] Field of Search ..... 336/229, 65, 67, 68, 336/90, 92, 210, 197, 198

[56] References Cited

U.S. PATENT DOCUMENTS

| | | | |
|---|---|---|---|
| 1,996,729 | 4/1935 | Rigandi | 336/92 X |
| 3,097,346 | 7/1963 | Honelick et al. | 336/68 |
| 4,054,856 | 10/1977 | Linscott, Jr. | 336/92 X |

*Primary Examiner*—Thomas J. Kozma

*Attorney, Agent, or Firm*—Scully, Scott, Murphy & Presser

[57] ABSTRACT

In the present invention, there is disclosed an electrical induction apparatus having a magnetic core unit being comprised of a toroidal magnetic core and at least one winding wound around the core and a casing for housing the magnetic core unit therein, comprising a support plate for supporting the bottom of the magnetic core unit having at least one opening, means for positioning the unit at a predetermined position in the casing being engageable to the opening of the support plate, a cylindrical member made of an insulating material which is so formed as to fit into the central hole of the unit, a mounting plate for fixing the unit being disposed on the top of the unit, an axial member passing through the central hole of the cylindrical member, one end of which is connected to the supporting plate and the other end of which is projected outwardly in the axial direction thereof, a nut means for fastening the mounting plate to hold the unit between the mounting plate and the support plate which is engageable to a threaded portion provided on the other end of the axial member, wherein the mounting plate is fixed to the casing so as to hang the unit in the casing.

5 Claims, 2 Drawing Figures

ELECTRICAL INDUCTION APPARATUS WITH SUPPORT INSIDE CASING

BACKGROUND OF THE INVENTION

1. Field of the Invention

The present invention relates to an electrical induction apparatus such as a transformer, an inductor, a reactor or the like, which uses a magnetic core unit being comprised of a magnetic core having an enclosed trunk defining a central opening and at least one winding wound around and along the circumference of the trunk.

2. Description of the Prior Art

There has been proposed a transformer having a magnetic core unit which is comprised of a toroidal magnetic core, a primary winding comprising a plurality of unit coils connected in series which encircle the trunk of the magnetic core and are circumferentially spaced about the periphery of the core and a secondary winding encircling said primary winding (See, for example, JP-A No. 115805/1983).

In the transformer of this type, it is difficult to hang the magnetic core unit in a casing since the magnetic core itself is encircled entirely with the windings and, therefore, the unit has no rigid portion exposed. Moreover, it is difficult to position the unit at a predetermined position in the casing exactly, since it is impossible to provide a fixing member on the unit due to the reason just mentioned above.

SUMMARY OF THE INVENTION

One object of the present invention is to provide an electrical induction apparatus being capable of hanging a magnetic core unit in a casing easily and of positioning and fixing the same easily and exactly in the casing.

According to the present invention, there is provided an electrical induction apparatus having a magnetic core unit being comprised of a toroidal magnetic core and at least one winding wound around the core and a casing for housing the magnetic core unit therein, comprising a support plate for supporting the bottom of the magnetic core unit having at least one opening, means for positioning the unit at a predetermined position in the casing being engageable to the opening of the support plate, a cylindrical member made of an insulating material which is so formed as to fit into the central hole of the unit, a mounting plate for fixing the unit being disposed on the top of the unit, an axial member passing through the central hole of the cylindrical member, one end of which is connected to the supporting plate and the other end of which is projected outwardly in the axial direction thereof, a nut means for fastening the mounting plate to hold the unit between the mounting plate and the supporting plate which is engageable to a threaded portion provided on the other end of the axial member, wherein the mounting plate is fixed to the casing so as to hang the unit in the casing.

According to the present invention, since the magnetic core unit is supported in a state fastened between the supporting plate and the mounting plate and the insulating cylindrical element is provided so as to pass through the axial center portion of the magnetic core unit, the magnetic core and the winding are held in a state that the relative positions therebetween are maintained exactly. Accordingly, it becomes possible to suspend the magnetic core unit maintaining the relative position by holding the mounting plate with hands or by providing a hanging means to be mounted on the mounting plate or the axial element. Therefore, the magnetic core unit can be brought into the casing easily. When the magnetic core unit is brought into the casing, the supporting plate is positioned exactly as the result of the engagement thereof to the element for positioning the unit. Also, the mounting plate is abutted to the inner surface of the casing. Therefore, the unit is positioned at a desired position in the casing easily and exactly. Further, since the mounting plate is fixed to the casing, the magnetic core unit fastened thereto is supported fixedly in the casing. Moreover, since the axial element for fastening is passed through the insulating cylindrical element, the insulating intensity of the winding against the earth is not lowered by the fastening axial element.

BRIEF DESCRIPTION OF THE DRAWINGS

The present invention will be more fully understood and further advantages will become apparent when reference is made to the following detailed description of the accompanying drawings in which.

DESCRIPTION OF THE PREFERRED EMBODIMENT

Figure 1:
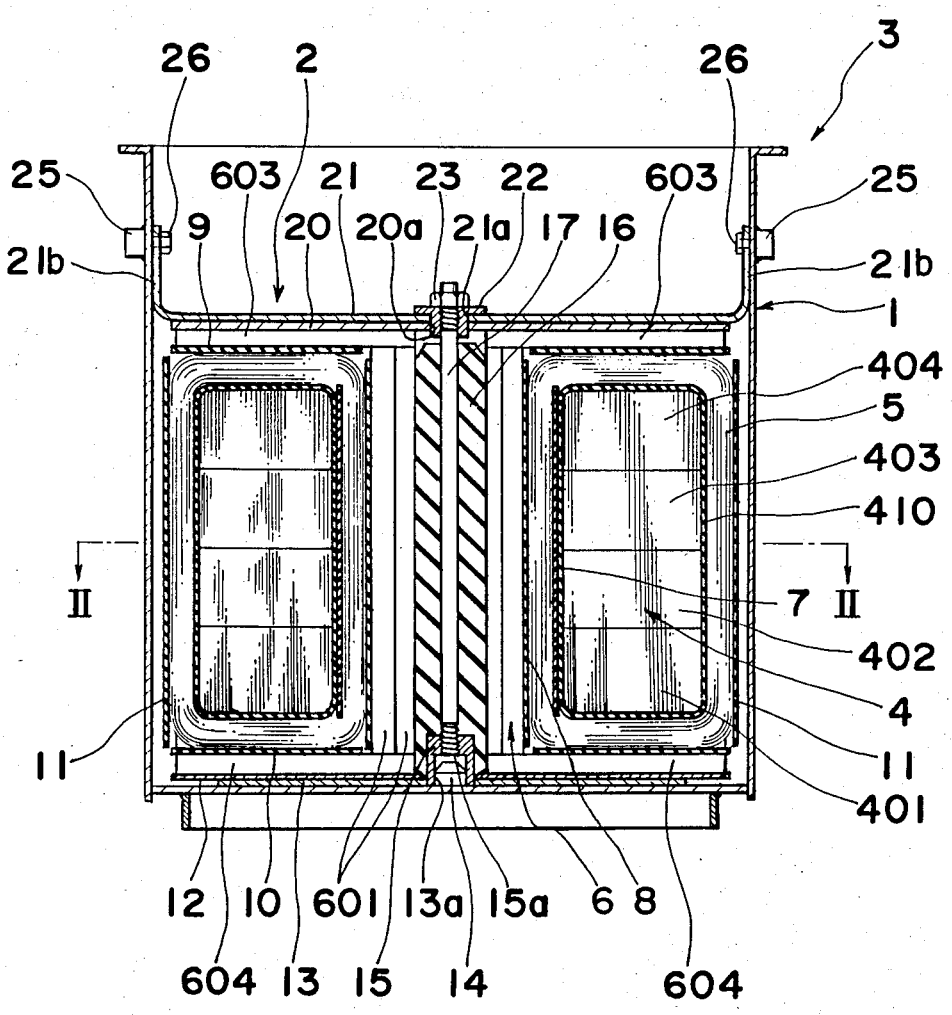
FIG. 1 is a sectional view of a transformer according to the present invention.
Figure 2:
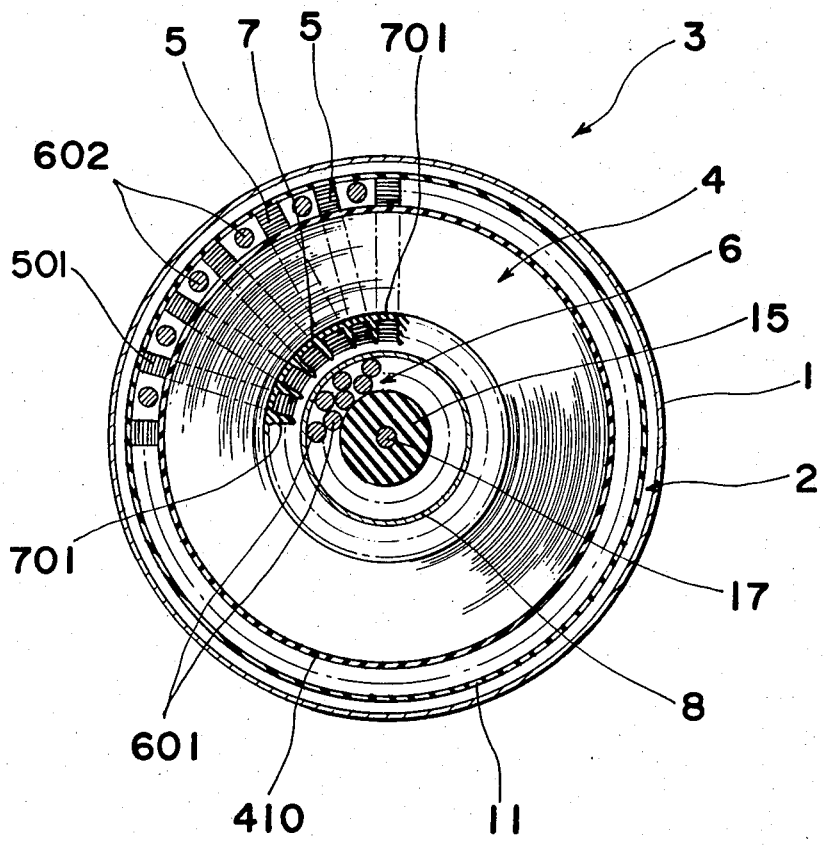
FIG. 2 is a sectional view along the line II—II of FIG. 1.

Referring now to FIGS. 1 and 2, a transformer 3 is essentially comprised of a cylindrical casing 1 having a bottom wall and a magnetic core unit 2 housed in the casing 1.

The magnetic core unit 2 is comprised of a toroidal magnetic core 4, a primary winding 5 being wound around the trunk of the core 4 so as to cover the outer surface of the core entirely and a secondary winding 6.

The core 4 is comprised of, for example, four toroidal core segments 401 to 404, each of which is formed by winding a strip material made of an amorphous alloy up to a toroidal coil of a predetermined number of turns. These segments are stacked in the axial direction thereof and stacked segments are wrapped with an appropriate insulating cover 410 such as an insulating tape.

Inside of the core 4, there fitted a cylindrical bobbin 7 having an outer diameter substantially equal to the inner diameter of the core. The bobbin 7 has a plurality of partition walls 701 which are formed so as to project in radially inside directions thereof at a predetermined pitch angle (see FIG. 2). Each unit coil 501 is formed by winding an electrically conductive strip material of a relatively narrow width around the trunk of the core into a coil of a predetermined number of turns positioned between adjacent two partition walls of the bobbin 7. These unit coils 501 are electrically connected in series to form the primary winding 5. Inside of the primary winding 5, a cylinder 8 for insulating between the primary and the secondary windings 5 and 6 is arranged coaxially with the magnetic core 4.

Also annular insulating plates 9 and 10 are arranged respectively on the upper and lower surfaces of the primary winding 5.

The secondary winding 6 is comprised of a plurality of link units each of which is comprised of an inner side column 601, an outer side column 602, an upper connecting rod 603 and a lower connecting rod 604. Every inner side column 601 is arranged inside of the cylinder 8 in the axial direction thereof and compiled on the adjacent inner side column shifting both in the peripheral direction and in the radial direction. The upper and lower connecting rods 603 and 604 are arranged respectively on the annular insulating plates 9 and 10 substantially in the radial direction thereof and either one connecting rod connects the inner side column 601 to the outer side column 602 being arranged in a space defined between adjacent two coil units of the primary winding 5. And the other connecting rod connects, for instance, the outer side column of one link unit to the inner side column of the adjacent link unit. Thus, the secondary winding 6 is completed by connecting every link units in series. The outer peripheral surface defined by the primary winding and/or by the secondary winding is covered with a cylindrical insulating cover 11. The magnetic core unit 2 is constituted by these elements mentioned above.

An annular lower insulating plate 12 is provided so as to cover the lower surface of the magnetic core unit 2. Between the insulating plate 12 and the bottom surface of the casing 1, a support plate 13 formed of a circular metal plate is arranged. As is shown in FIG. 3, the support plate 13 has a small circular aperture 13*a* provided corresponding to a projection 14 for positioning the magnetic core unit 2. The projection 14 for positioning is fixed at the center of the bottom wall of the casing by welding. The projection 14 has a tapered portion at the top thereof. At the center of the support plate, there is fixed a hub 15, for instance by welding, lower end of which is fitted into the aperture 13*a*. The hub 15 has a bore into which the projection 14 for positioning is fitted. The tapered portion of the projection 14 makes the hub 15 to fit to the projection easier.

As is shown in FIGS. 1 and 2, there is inserted a cylindrical insulating element 16 into the central bore of the magnetic core unit. The cylindrical insulating element 16 is tapered at the upper and lower ends thereof in order to insert the element into the central bore of the core easier. The cylindrical insulating element 16 has a hole for fitting the hub 15 of the support plate 13 thereinto at the lower end thereof. A fastening rod 17 having threaded portions at both ends thereof is inserted into the axial hole passing through the insulating element 16 in the axial direction thereof. The lower threaded end of the fastening rod 17 is engaged to a threaded hole 15*a* formed in the axial direction of the hub 15.

As shown in FIG. 1, there is provided an upper insulating disk plate 20 so as to cover the upper surface of the magnetic core unit. On the upper insulating disk plate 20, a mounting plate 21 for fixing the core unit to the casing is provided. The mounting plate 21 is formed as a strip of a metal having a length longer than the diameter of the disk plate 20 each end of which is so bent at right angle upwardly as to contact to the inner wall of the casing. The insulating disk plate 20 and the mounting plate 21 have respectively central holes 20*a* and 21*a* having a same diameter at each center thereof. Into these central holes 20*a* and 21*a*, a bushing 22 made of an insulating material is inserted. The fastening rod 17 mentioned above is passed through the bushing 22 and a fastening nut 23 is engaged to the upper threaded portion thereof projecting above the mounting plate 21. As the nut 23 is rotated in the fastening direction, the support plate 13 and the mounting plate 21 are so fastened as to approach to each other in the state that the magnetic core unit lies therebetween. In other words, the magnetic core unit is held between the supporting plate 13 and the mounting plate 21. Each of bent portions 21*b* of the mounting plate 21 has a hole 21*c* for fixing the mounting plate to the casing. Corresponding to the mounting holes 21*c*, there are provided holes on the side wall of the casing. At the outside of each hole of the casing, a blind nut 25 is fixed by welding which seals the hole hermetically. The mounting plate 21 is fixed to the casing by engaging mounting bolts 26 to blind nuts 25 respectively and fastening the mounting plate 21 to the casing.

After fixing the magnetic core, an insulating oil is filled into the casing and, thereafter, the upper aperture of the casing is sealed by a suitable cover plate (not shown). Thus the transformer is completed.

According to the structures of the embodiment of the present invention, it becomes possible to suspend the magnetic core unit by holding the mounting plate 21 with hand or by fixing a suitable hanging tool to the threaded portion of the fastening rod 17, since the magnetic core unit is held between the supporting plate 13 and the mounting plate 21 firmly. Upon bringing the suspended core unit down in the casing, the positioning projection 14 is fitted into the hub 15 of the supporting plate 13. Accordingly, the magnetic core unit is easily positioned at the aimed position exactly. Further, the upper portion of the core unit is firmly supported to the casing, since the mounting plate 21 is fixed to the casing tightly with mounting bolts. Moreover, since the insulating cylindrical element 16 is inserted into the central bore defined by the secondary winding of the core unit, the core itself and the windings are positioned coaxially and, therefore, all the elements of the magnetic core unit are held as if they form a unit body.

In the case that the insulating bushing is lain between the mounting plate and the fastening axial element as in the preferred embodiment mentioned above, there prevented a possible closed circuit which might be formed by the casing, the mounting plate, the axial element and the supporting plate. Therefore, possible power loss and increase of the heat generated in the apparatus due to a short circuit current are prevented.

Moreover, it becomes possible to reduce the volume and the weight of the apparatus in the case that the magnetic core unit and the casing are formed cylindrically as in the preferred embodiment, since the quantity of the oil to be filled in the casing can be minimized in that case.

While there has been described a preferred embodiment, modifications and variations being obvious to those skilled in the art are possible without departing from the spirit of the invention. The scope is therefore to be determined solely by the appended claims.

Although the present invention is applied to a transformer in the preferred embodiment, the present invention is not limited to the transformer but is applicable to other induction apparatus such as inductors, reactors and the like.

What is claimed is:

1. An electrical induction apparatus having a magnetic core unit being comprised of a toroidal magnetic core and at least one winding wound around the core and a casing for housing the magnetic core unit therein, comprising a support plate for supporting the bottom of the magnetic core unit having at least one opening, means for positioning the unit at a predetermined position in the casing being engageable to the opening of the support plate, a cylindrical member made of an insulating material which is so formed as to fit into the central hole of the unit, a mounting plate for fixing the unit being disposed on the top of the unit, an axial member passing through the central hole of the cylindrical member, one end of which is connected to the supporting plate and the other end of which is projected outwardly in the axial direction thereof, a nut means for fastening the mounting plate to hold the unit between the mounting plate and the supporting plate which is engageable to a threaded portion provided on the other end of the axial member, wherein the mounting plate is fixed to the casing so as to hang the unit in the casing.

2. An insulating induction apparatus according to claim 1, in which the means for positioning is a projection fixed on the bottom surface of the casing.

3. An insulating induction apparatus according to claim 2, in which the support plate has a hub being engageable to the projection.

4. An insulating induction apparatus according to claim 3, in which one end of the axial member is fixed to the hub.

5. An insulating induction apparatus according to claim 1, the mounting plate and the axial member are insulated from each other by an insulating bushing through which the axial member is passed.

* * * * *